US007242356B2

(12) United States Patent
Lu et al.

(10) Patent No.: US 7,242,356 B2
(45) Date of Patent: Jul. 10, 2007

(54) ANTENNA ASSEMBLY FOR USE IN A FOLDABLE MOBILE PHONE

(75) Inventors: Shih-Wen Lu, Taipei Hsien (TW); Hao-Chun Tung, Chinmen Hsien (TW)

(73) Assignee: BENQ CORPORATION (TW)

( * ) Notice: Subject to any disclaimer, the term of this patent is extended or adjusted under 35 U.S.C. 154(b) by 0 days.

(21) Appl. No.: 11/355,231

(22) Filed: Feb. 15, 2006

(65) Prior Publication Data

US 2006/0187128 A1 Aug. 24, 2006

(30) Foreign Application Priority Data

Feb. 18, 2005 (TW) ..... 94104781 A

(51) Int. Cl.
*H01Q 1/24* (2006.01)

(52) U.S. Cl. ..... 343/702; 343/700 MS

(58) Field of Classification Search ..... 343/702, 343/700 MS, 860

See application file for complete search history.

(56) References Cited

U.S. PATENT DOCUMENTS

| | | | | |
|---|---|---|---|---|
| 6,348,897 | B1 * | 2/2002 | Alameh et al. | 343/702 |
| 2003/0216150 | A1 * | 11/2003 | Ueda | 455/552.1 |
| 2006/0055609 | A1 * | 3/2006 | Harano | 343/702 |
| 2007/0013591 | A1 * | 1/2007 | Ota et al. | 343/702 |

* cited by examiner

*Primary Examiner*—Tan Ho
(74) *Attorney, Agent, or Firm*—Ladas & Parry LLP

(57) ABSTRACT

A mobile phone includes a main body, a cover member and an antenna assembly having a radiating metal strip and a matching circuit. The radiating metal strip has a feeding leg and a short-circuit leg coupled electrically to the matching circuit in such a manner that the latter provides impedance matching for the antenna assembly. A switching unit couples the cover member pivotally on the main body, and determines whether the mobile phone is in a first operating mode or a second operating mode. Either in the first or second operating mode, the antenna assembly in the mobile phone has similar characteristic by virtue of the impedance matching provided by the matching circuit.

14 Claims, 4 Drawing Sheets

ANTENNA ASSEMBLY FOR USE IN A FOLDABLE MOBILE PHONE

FIELD OF THE INVENTION

The present invention relates to an antenna assembly, more particularly to a built-in antenna assembly for use in a foldable mobile phone (generally known as flip cell phone).

BACKGROUND OF THE INVENTION

Due to rapid innovation in the electronic communication technology, a mobile phone becomes an inevitable instrument in our daily life. Without it, he or she feels loss in touch with his friends and relatives. In order to achieve high reliability in the transmitting and receiving signals, the quality and functionality of the antenna assembly play a major role in the mobile phone. There are generally two types of antenna assembly used in the mobile phone, i.e. built-in antenna assembly (which is generally contained within the casing of the mobile phone) or an exposed type (i.e. the antenna assembly projects outwardly from the casing of the mobile phone). A mobile phone with a built-in antenna assembly is preferred to when compared to ones having an exposed antenna assembly, since the latter may accidentally collides with an object, thereby rendering the ruin of the mobile phone. In addition, the built-in antenna assembly provides more attractive appearance. For aesthetic and portability reasons, the mobile phone is generally constructed in compact size. It is therefore the prime object of the manufacture to improve the functionality of the quality of the antenna assembly in the mobile phone.

When a monopole antenna is used as the built-in antenna assembly in the foldable mobile phone, the antenna assembly provides fine transmitting ability. However, a clear area of the mobile phone may affect the transmitting ability by of the antenna assembly (i.e. The clear area is located under the antenna assembly of the mobile phone without any metal material). When the mobile is in the folded position, the clear area changes, thereby deviating the resonance frequency and causing degradation of the signal transmission bandwidth. Under this condition, the vertical direction of the transmission characteristic of the antenna assembly gets worse.

Referring to FIG. 1A, an unfolded position of a conventional mobile phone 10 is shown to include a lower printed circuit board 14, an upper printed circuit board 16 and an antenna unit 12. The antenna unit 12 is mounted on the lower printed circuit board 14, and includes an insulated plate 122 and a radiating metal strip 120 that is responsible for providing the resonance frequency of the antenna unit 12. A flexible printed cable 18 interconnects and transmits signals between the lower and upper printed circuit boards 14, 16.

FIG. 1B is a perspective view of the conventional mobile phone 10 in a folded position (shown in upside down configuration for illustration), wherein the lower printed circuit board 14 is disposed above the upper printed circuit board 16. Under this condition, the volume of the vacuum chamber is altered by virtue of shielding of the upper printed circuit board 16, thereby deviating the resonance frequency and causing remarkable degradation of the signal transmission bandwidth.

SUMMARY OF THE INVENTION

The object of the present invention is to provide a built-in antenna assembly for use in a foldable mobile phone, the antenna assembly has a unique structure to provide the similar characteristic when the mobile phone is the first and second operating modes, i.e. whether the mobile phone is in an unfolded or folded position.

Another object of the present invention is to provide a foldable mobile phone having an antenna assembly which provides the similar characteristic regardless of its positions, i.e. whether the mobile phone is in an unfolded or folded position.

In one aspect of the present invention, an antenna assembly is provided for use in a foldable mobile phone. The mobile phone includes at least one first base board and a switching unit for determining whether the mobile phone is in a first operating mode or a second operating mode. The antenna assembly accordingly includes: a radiating metal strip fabricated on the first base board and having a feeding leg and a short-circuit leg; and a matching circuit fabricated on the first base board and coupled electrically to the short-circuit leg in order to provide impedance matching for the antenna assembly. When the mobile phone is disposed in the first operating mode, the switching unit causes disengagement of the short-circuit leg with respect to the ground, thereby turning the antenna assembly to a monopole type antenna, and when the mobile phone is disposed in the second operating mode, the switching unit causes engagement of the short-circuit leg with respect to the ground, thereby turning the antenna assembly to an inverted F-type antenna such that either in the first operating mode or the second operating mode, the antenna assembly has similar characteristic by virtue of the impedance matching provided by the matching circuit.

In another aspect of the present invention, a mobile phone is provided to include: a lower member having a first base board; an upper member disposed above the lower member, and having a second base board; a switching unit for determining whether the mobile phone is in a first operating mode or a second operating mode; and an antenna assembly fabricated on the first base board for transmitting and receiving wireless signals. The antenna assembly includes: a radiating metal strip fabricated on the first base board, and having a feeding leg and a short-circuit leg; a matching circuit fabricated on the first base board and coupled electrically to the short-circuit leg in order to provide impedance matching for the antenna assembly, and a signal-processing module for processing outgoing and incoming wireless signals. When the mobile phone is disposed in the first operating mode, the switching unit causes disengagement of the short-circuit leg with respect to the ground, thereby turning the antenna assembly to a monopole type antenna. When the mobile phone is disposed in the second operating mode, the switching unit causes engagement of the short-circuit leg with respect to the ground, thereby turning the antenna assembly to an inverted F-type antenna such that either in the first operating mode or the second operating mode, the antenna assembly has similar characteristic by virtue of the impedance matching provided by the matching circuit.

In still another object of the present invention, an antenna assembly is provided for use in a mobile phone in order to transmit and receive wireless signals. The mobile phone includes a lower member, an upper member coupled pivotally to the lower member, and a switching unit for determining whether the mobile phone is in a first operating mode or a second operating mode. The antenna assembly includes: a radiating metal strip fabricated on the first base board, and having a feeding leg and a short-circuit leg; and a matching circuit fabricated on the first base board and coupled electrically to the short-circuit leg in order to provide impedance matching for the antenna assembly. When the mobile phone is disposed in the first operating mode, the upper member is spaced apart from the lower member such that the switching unit causes disengagement of the short-circuit leg with respect to the ground, thereby turning the antenna assembly to a monopole type antenna. When the mobile phone is disposed in the second operating mode, the upper member abuts against the lower member such that the switching unit causes engagement of the short-circuit leg with respect to the ground, thereby turning the antenna assembly to an inverted F-type antenna such that either in the first operating mode or the second operating mode, the antenna assembly has similar characteristic by virtue of the impedance matching provided by the matching circuit.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTIONS OF THE PREFERRED EMBODIMENTS

Figure 1A:
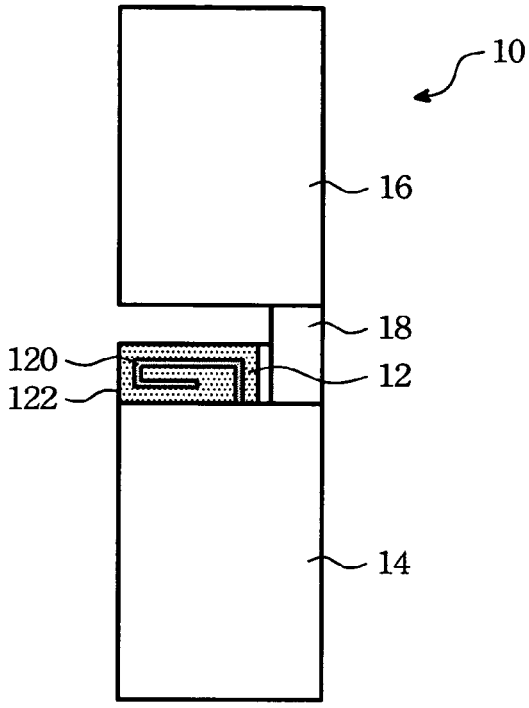
Fig. 1A (Prior Art)
FIG. 1A is an unfolded view of a conventional mobile phone, illustrating how an antenna assembly is mounted therein.
Figure 1B:
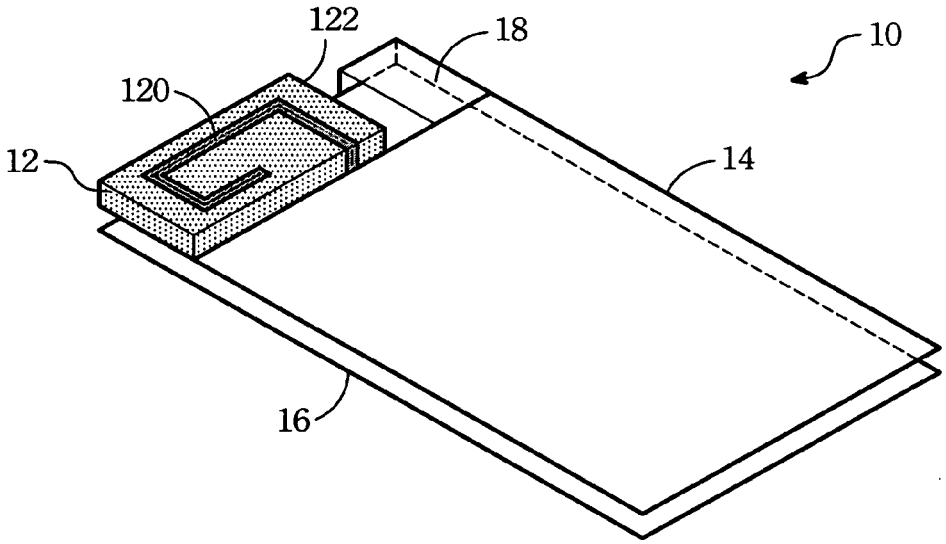
Fig. 1B (Prior Art)
FIG. 1B is a perspective overturned view, illustrating how the antenna assembly is mounted in the conventional mobile phone.
Figure 2:
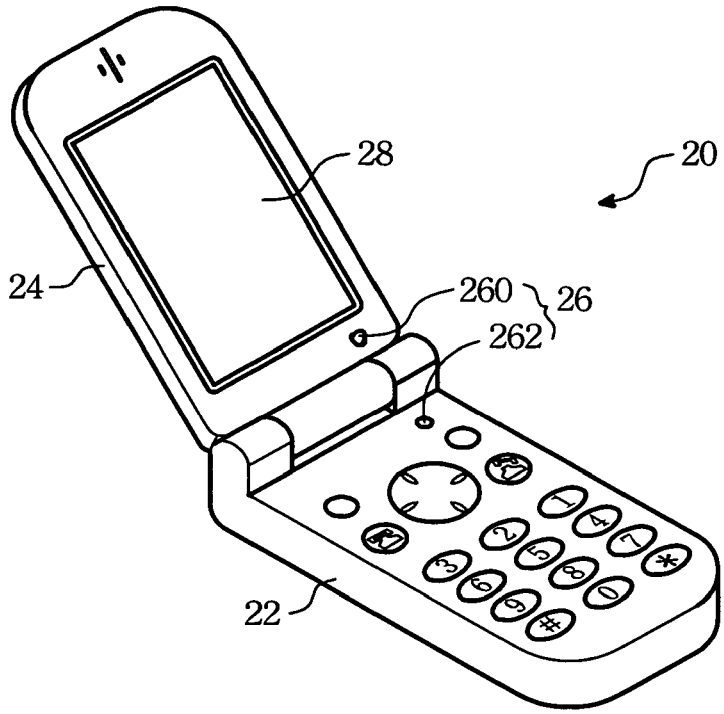
FIG. 2 is a perspective unfolded view of a foldable mobile phone according to the present invention.

Referring to FIG. 2, a perspective unfolded view of the preferred embodiment of a foldable mobile phone 20 (generally known as flip cell phone) according to the present invention is shown to include a lower member 22 (hereinafter the main body), an upper member 24 (hereinafter the cover member), a switching unit 26, and an antenna assembly 30 (see FIG. 3).

Figure 3:
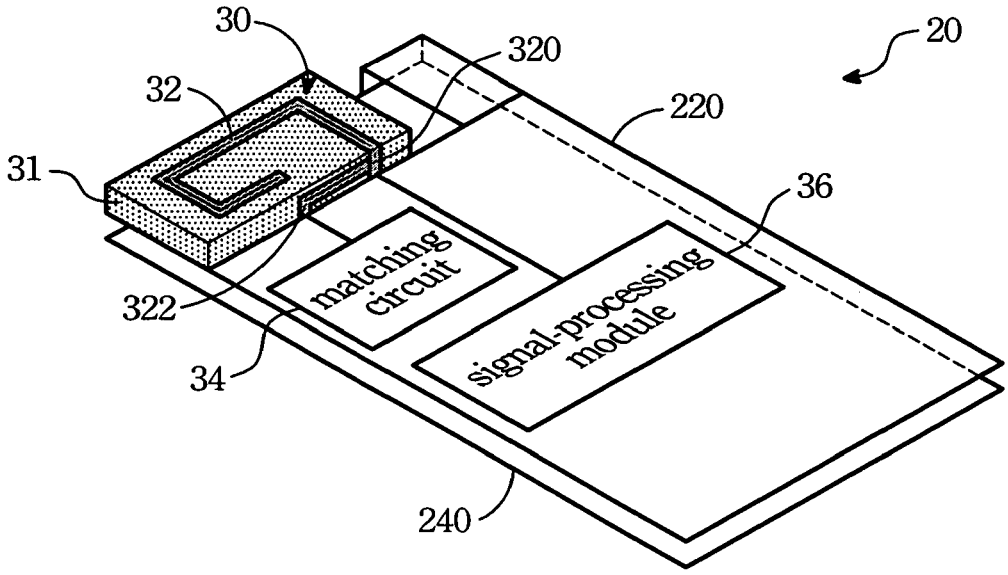
FIG. 3 is a perspective folded view of the mobile phone according to the present invention.

FIG. 3 shows a folded position of the mobile phone 20 of the present invention. As illustrated, the main body 22 has a first base board 220 generally made from dielectric material. The cover member 24 is disposed on and is coupled pivotally to the main body 22 via the switching unit 26 in such a manner that the switching unit 26 can determine whether the mobile phone 20 is in a first operating mode (i.e. the unfolded position, wherein the cover member 24 is spaced apart from the main body 22 as shown in FIG. 2) or a second operating mode (the folded position, wherein the cover member 24 abuts against the main body 22 as shown in FIG. 3). The cover member 24 has a second base board 240 and a display panel 28. A plurality of electronic components (not visible) are mounted on the first and second base boards 220, 240 in order to provide specific functions of the mobile phone. A flexible printed cable (not visible) is used for interconnecting the electronic components on the boards, and since the structure of function of the same are not relevant feature of the present invention, a detailed description thereof is omitted herein for the sake of brevity.

In this embodiment, the first base board 220 has a dimension of 40×80 $mm^2$ while the second base board 240 has a dimension slightly smaller than the first base board 220. The switching unit 26 includes a projection 260 projecting outwardly from the cover member 24 and a retention recess 262 formed in the main body 22 such that extension and not extension of the projection 260 with respect to the retention recess 262 can determine the modes (i.e. folded or unfolded position) of the mobile phone of the present invention.

The antenna assembly 30 is fabricated on the first base board 220 for transmitting and receiving wireless signals. The antenna assembly 30 includes a radiating metal strip 32, a matching circuit 34, and a signal-processing module 36. The radiating metal strip 32 is fabricated on an insulated plate 31 by screen-printing technology. The insulated plate 31 has a dimension of 9×13×30 $mm^3$, and is mounted on the first base board 220. Tiny brass strip can serve as the radiating metal strip 32. The radiating metal strip 32 has a feeding leg 320 and a short-circuit leg 322. The feeding leg 320 is used for coupling electrically the signal-processing module 36 in such a manner that the signal-processing module 36 can process the outgoing and incoming radio signals by utilizing the embedded electrical circuits (such as wave-filtering circuit, amplifier circuit). The short-circuit leg 322 has one end coupled to the radiating metal strip 32 and the other end coupled to the matching circuit 34 so that the latter provides an impedance matching for the antenna assembly 30.

Figure 4A:
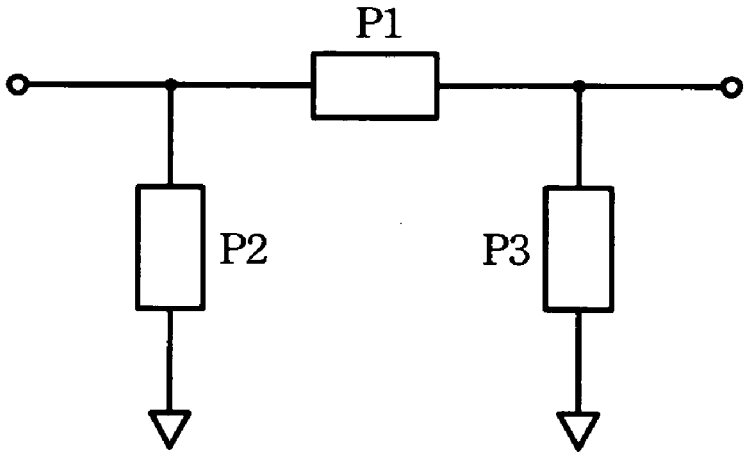
FIGS. 4A and 4B respectively show a matching circuit of the mobile phone of the present invention, the circuit having a π-shaped configuration or T-shaped configuration.
Figure 4B:
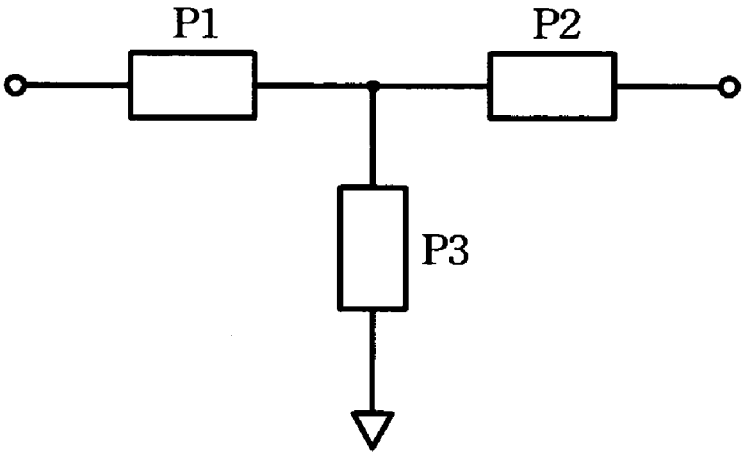

The antenna assembly 30 is preferably allotted to a predetermined transmission frequency. The radiating metal strip 32 is constructed in such a manner to have a length equivalent to a quarter of the predetermined transmission frequency. In one embodiment of the present invention, the matching circuit 34 has a π-shaped configuration or T-shaped configuration. As illustrated in FIGS. 4A and 4B, the π-shaped matching circuit 34 includes some passivated components P1-P3 (such as resistor, capacitor or inductor and a combination of two or three elements). The aforesaid elements are used for adjusting the impedance matching of the antenna assembly 30. The person known in the art can various modifications can be used to achieve the same effect, it is hope that the scope of the present invention should not be limited only to the passivated element.

When the mobile phone 20 of the present invention is disposed in the first operating mode (i.e. unfolded position), the switching unit 26 causes disengagement of the short-circuit leg with respect to the ground, thereby turning the antenna assembly 30 to a monopole type antenna, and when the mobile phone is disposed in the second operating mode (i.e. folded position), the switching unit 26 causes engagement of the short-circuit leg with respect to the ground, thereby turning the antenna assembly 30 to an inverted F-type antenna. Under this condition, whether the mobile phone 20 of the present invention is in the first operating mode or the second operating mode, the antenna assembly has similar characteristic (such as resonance frequency, bandwidth, the impedance matching of 50 ohms) by virtue of the impedance matching provided by the matching circuit 34.

An important aspect to note is that though the foldable mobile phone is illustrated in the present invention, but the antenna assembly 30 can be employed to several other types of mobile phones. It is therefore hope that scope and spirit of the present invention should encompass other modifications as well.

Figure 5A:
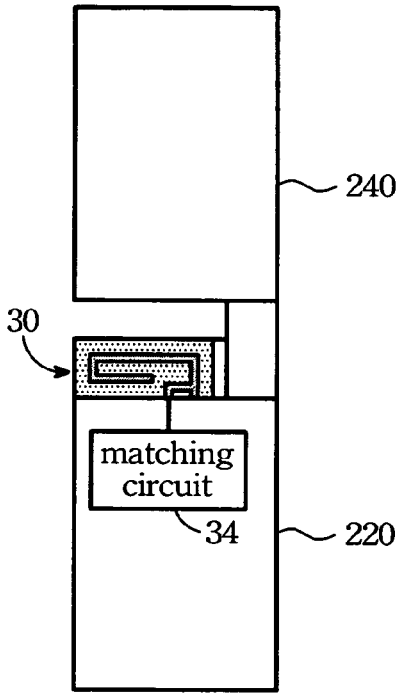
FIGS. 5A, 5B, 5C and 5D respectively show four embodiments of the antenna assembly employed in the mobile phone of the present invention.
Figure 5B:
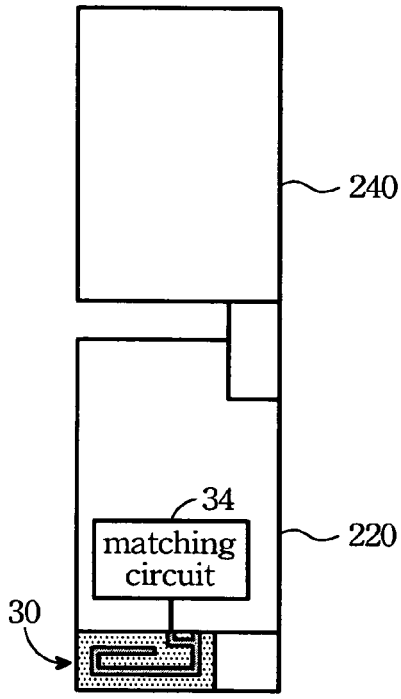
Figure 5C:
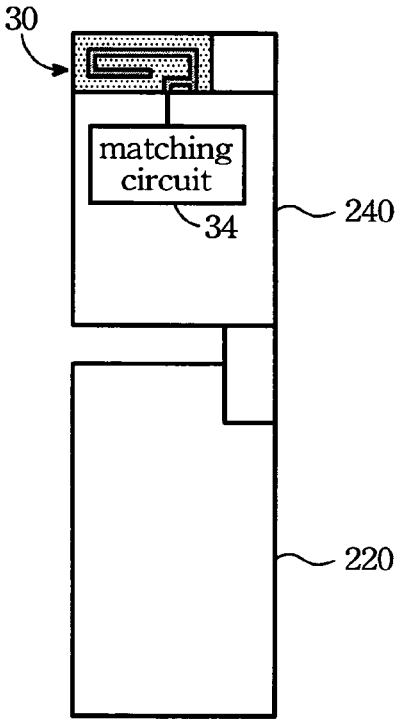
Figure 5D:
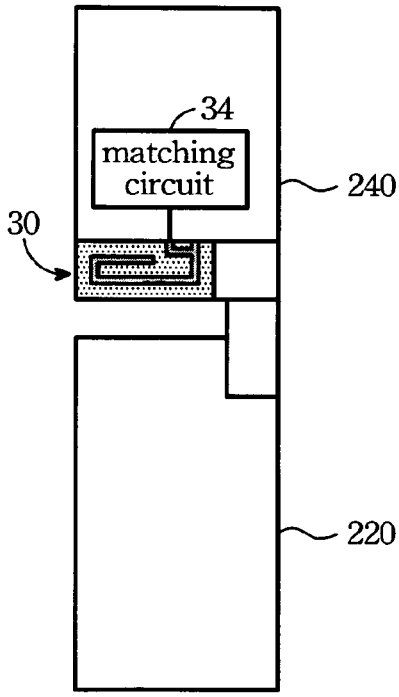

FIGS. 5A, 5B, 5C and 5D respectively show different mounting designs in the mobile phones, wherein in FIGS. 5A and 5B, the antenna assembly 30 is mounted on the insulated plate of the first base board 220 in the main body at the upper and lower portions thereof. In FIGS. 5C and 5D, the antenna assembly 30 is mounted on the insulated plate of the second base board 240 in the cover member at the upper and lower portions thereof.

In summary, by virtue of presence of the antenna assembly 30 in the mobile phone 20 of the present invention, the latter possesses the similar characteristic in the folded and unfolded positions, thereby eliminating the occurrence of accidental collision of the exposed antenna assembly with an object as encountered during use of the conventional mobile phone.

While the invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

We claim:

1. An antenna assembly for use in a mobile phone for transmitting and receiving wireless signals, the mobile phone including at least one first base board and a switching unit for determining whether the mobile phone is in a first operating mode or a second operating mode, the antenna assembly comprising:

a radiating metal strip fabricated on the first base board, and having a feeding leg and a short-circuit leg;

a matching circuit fabricated on the first base board and coupled electrically to the short-circuit leg in order to provide an impedance matching for the antenna assembly;

wherein, when the mobile phone is disposed in the first operating mode, the switching unit causes disengagement of the short-circuit leg with respect to the ground, thereby turning the antenna assembly to a monopole type antenna, and when the mobile phone is disposed in the second operating mode, the switching unit causes engagement of the short-circuit leg with respect to the ground, thereby turning the antenna assembly to an inverted F-type antenna such that either in the first operating mode or the second operating mode, the antenna assembly has similar characteristic by virtue of the impedance matching provided by the matching circuit.

2. The antenna assembly according to claim 1, wherein the antenna assembly is allotted to a predetermined transmission frequency, the radiating metal layer having a length equivalent to a quarter of the predetermined transmission frequency.

3. The antenna assembly according to claim 1, wherein the matching circuit has a π-shaped configuration or T-shaped configuration.

4. The antenna assembly according to claim 1, wherein the mobile phone is a foldable type.

5. The antenna assembly according to claim 4, wherein the foldable mobile phone includes a lower member and an upper member coupled pivotally to the lower member, the upper member having a display panel.

6. The antenna assembly according to claim 5, wherein when the mobile phone is disposed in the first operating mode, the upper member is spaced apart from the lower member and when the mobile phone is disposed in the second operating mode, the upper member abuts against the lower member.

7. A mobile phone comprising:

a lower member having a first base board;

an upper member disposed above the lower member, and having a second base board;

a switching unit for determining whether the mobile phone is in a first operating mode or a second operating mode;

an antenna assembly fabricated on the first base board for transmitting and receiving wireless signals, the antenna assembly including a radiating metal strip fabricated on the first base board, and having a feeding leg and a short-circuit leg;

a matching circuit fabricated on the first base board and coupled electrically to the short-circuit leg in order to provide an impedance matching for the antenna assembly, a signal-processing module for processing outgoing and incoming wireless signals;

wherein, when the mobile phone is disposed in the first operating mode, the switching unit causes disengagement of the short-circuit leg with respect to the ground, thereby turning the antenna assembly to a monopole type antenna, and when the mobile phone is disposed in the second operating mode, the switching unit causes engagement of the short-circuit leg with respect to the ground, thereby turning the antenna assembly to an inverted F-type antenna such that either in the first operating mode or the second operating mode, the antenna assembly has similar characteristic by virtue of said impedance matching provided by said matching circuit.

8. The mobile phone according to claim 7, wherein the antenna assembly is allotted to a predetermined transmission frequency, the radiating metal layer having a length equivalent to a quarter of the predetermined transmission frequency.

9. The mobile phone according to claim 7, wherein the matching circuit has a π-shaped configuration or T-shaped configuration.

10. The mobile phone according to claim 7, wherein the mobile phone is a foldable type.

11. An antenna assembly for use in a mobile phone for transmitting and receiving wireless signals, the mobile phone including a lower member, an upper member coupled pivotally to the lower member, and a switching unit for determining whether the mobile phone is in a first operating mode or a second operating mode, the antenna assembly comprising:

a radiating metal strip fabricated on the first base board, and having a feeding leg and a short-circuit leg; and a matching circuit fabricated on the first base board and coupled electrically to the short-circuit leg in order to provide an impedance matching for the antenna assembly;

wherein, when the mobile phone is disposed in the first operating mode, the upper member is spaced apart from the lower member such that the switching unit causes disengagement of the short-circuit leg with respect to the ground, thereby turning the antenna assembly to a monopole type antenna, and when the mobile phone is disposed in the second operating mode, the upper member abuts against the lower member such that the switching unit causes engagement of the short-circuit leg with respect to the ground, thereby turning the antenna assembly to an inverted F-type antenna such that either in the first operating mode or the second operating mode, the antenna assembly has similar characteristic by virtue of said impedance matching provided by said matching circuit.

12. The antenna assembly according to claim 11, wherein the antenna assembly is allotted to a predetermined transmission frequency, the radiating metal layer having a length equivalent to a quarter of the predetermined transmission frequency.

13. The antenna assembly according to claim 11, wherein the matching circuit has a π-shaped configuration or T-shaped configuration.

14. The antenna assembly according to claim 11, wherein the mobile phone is a foldable type.

* * * * *